US008454108B2

(12) United States Patent
Fishkin et al.

(10) Patent No.: US 8,454,108 B2
(45) Date of Patent: Jun. 4, 2013

(54) PRINTHEAD SUPPORT STRUCTURE INCLUDING THERMAL INSULATOR

(75) Inventors: Mikhail Fishkin, Rochester, NY (US); Andrew Ciaschi, Pittsford, NY (US); Jinquan Xu, Tolland, CT (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/217,715

(22) Filed: Aug. 25, 2011

(65) Prior Publication Data

US 2013/0050348 A1 Feb. 28, 2013

(51) Int. Cl.
*B41J 25/308* (2006.01)

(52) U.S. Cl.
USPC ..... 347/8

(58) Field of Classification Search
USPC ..... 347/40, 54, 63, 102, 5, 8
See application file for complete search history.

(56) References Cited

U.S. PATENT DOCUMENTS

| | | | | |
|---|---|---|---|---|
| 6,989,123 | B2 * | 1/2006 | Lee et al. | 264/299 |
| 7,419,257 | B2 * | 9/2008 | Mouri et al. | 347/103 |
| 2007/0120892 | A1 | 5/2007 | Iwata | |

* cited by examiner

*Primary Examiner* — An Do
(74) *Attorney, Agent, or Firm* — William R. Zimmerli

(57) ABSTRACT

A printing system includes a plurality of inkjet printheads for printing on a print media that is moved relative to the plurality of printheads and a support structure for locating the plurality of printheads relative to the print media. The support structure includes a face adjacent to the print media. The face of the support structure includes a thermal insulator.

20 Claims, 6 Drawing Sheets

PRINTHEAD SUPPORT STRUCTURE INCLUDING THERMAL INSULATOR

FIELD OF THE INVENTION

This invention relates generally to the field of digitally controlled printing systems, and in particular to limiting condensation accumulation on component surfaces included in these systems.

BACKGROUND OF THE INVENTION

In a digitally controlled printing system, a print media is directed through a series of components. The print media can be a cut sheet or a continuous web. A web or cut sheet transport system physically moves the print media through the printing system. As the print media moves through the printing system, liquid, for example, ink, is applied to the print media by one or more printheads. This is commonly referred to a jetting of the liquid. The jetting of the liquid along with the moisture evaporating from the liquid previously applied to the print media produces warm humid air in a clearance gap located between the printhead and the print media. The physical movement of the print media through the printing system then draws the warm humid air through the printing system.

The printheads are typically located and aligned by a support structure. If the support structure is at a lower temperature than the dew point of warm humid air in the clearance gap, condensation can accumulate on the surface of the support structure adjacent to the print media. Additionally, the printheads are often arranged in a staggered formation so that an overlap region is created between printheads. In the overlap regions, there are areas of increased condensation due to the increased volume of warm humid air produced by the overlapped printheads. Condensation that sufficiently accumulates can drip or otherwise touch the print media and adversely affect print quality.

Therefore, there is a need for a printing system that can effectively reduce or limit condensation on surfaces within the printing system while maintaining accurate alignment and clearance gaps to ensure print quality.

SUMMARY OF THE INVENTION

According to one aspect of the invention, a printing system includes a plurality of inkjet printheads for printing on a print media that is moved relative to the plurality of printheads and a support structure for locating the plurality of printheads relative to the print media. The support structure includes a face adjacent to the print media. The face of the support structure includes a thermal insulator.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
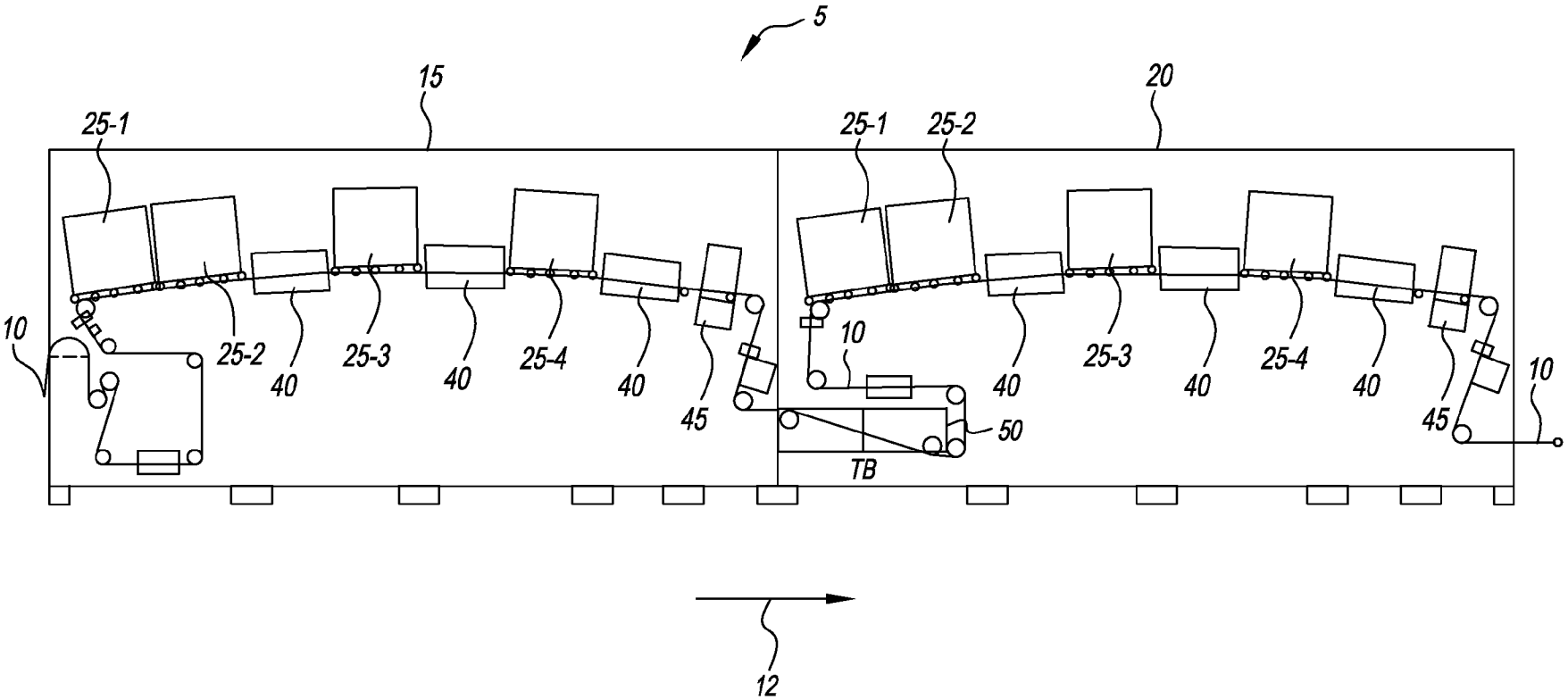
FIG. 1 is a schematic side view of a digital printing system for continuous web printing on a print media.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example embodiments of the present invention are illustrated schematically and not to scale for the sake of clarity. One of ordinary skill in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is commonly used for printing on paper, however, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquids is applied in a consistent, metered fashion, particularly if the desired result is a thin layer or coating.

Inkjet printing is a non-contact application of an ink to a print media. Typically, one of two types of ink jetting mechanisms are used and are categorized by technology as either drop on demand ink jet (DOD) or continuous ink jet (CH).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Additionally, there are typically two types of print media used with inkjet printing systems. The first type is commonly referred to as a continuous web while the second type is commonly referred to as a cut sheet(s). The continuous web of print media refers to a continuous strip of media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via rollers and drive wheels or via a conveyor belt system that is routed through the inkjet printing system.

The invention described herein is applicable to both types of printing technologies. As such, the term printhead, as used herein, is intended to be generic and not specific to either technology. Additionally, the invention described herein is applicable to both types of print media. As such, the term print media, as used herein, is intended to be generic and not as specific to either type of print media or the way in which the print media is moved through the printing system.

Figure 2:
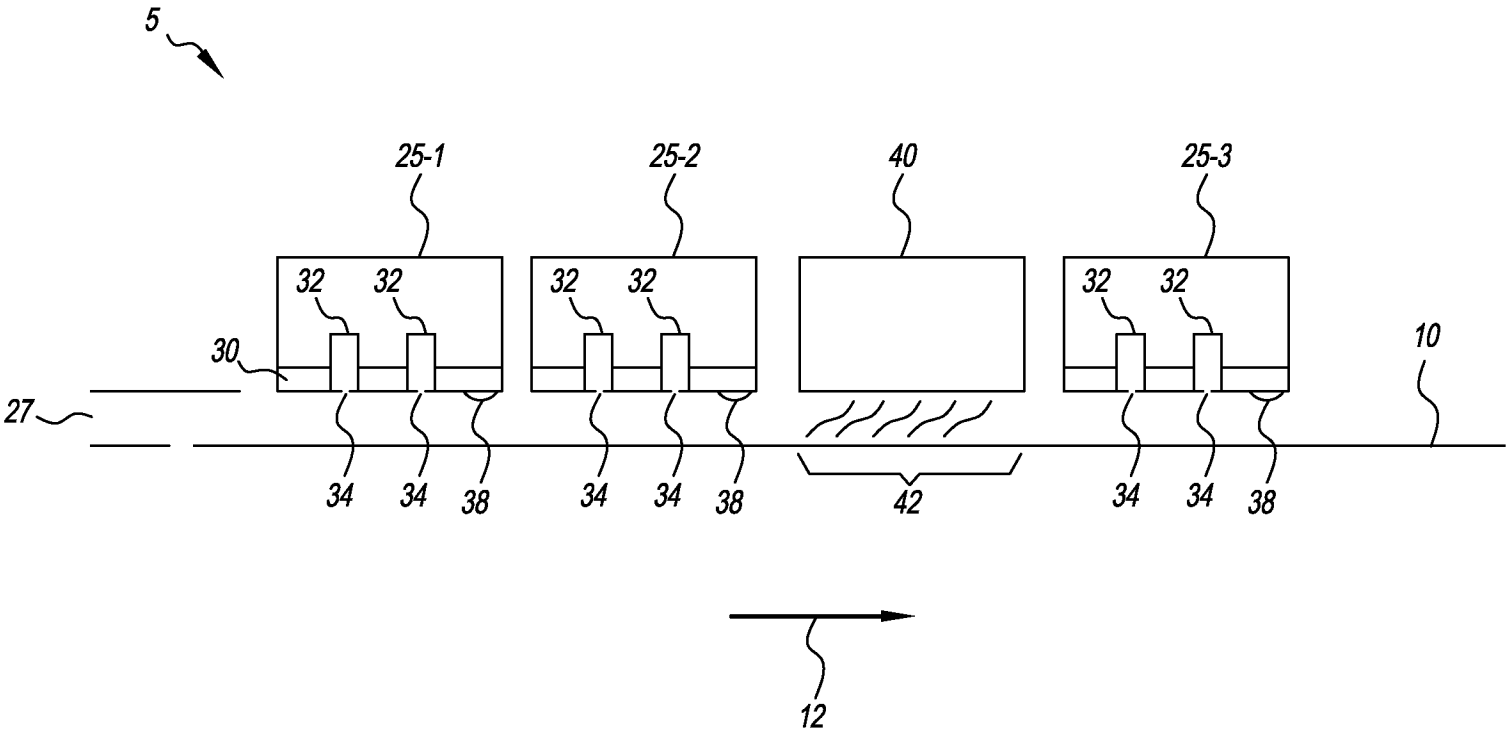
FIG. 2 is a schematic side view of components in a portion of the digital printing system, showing increased condensation regions.
Figure 4:
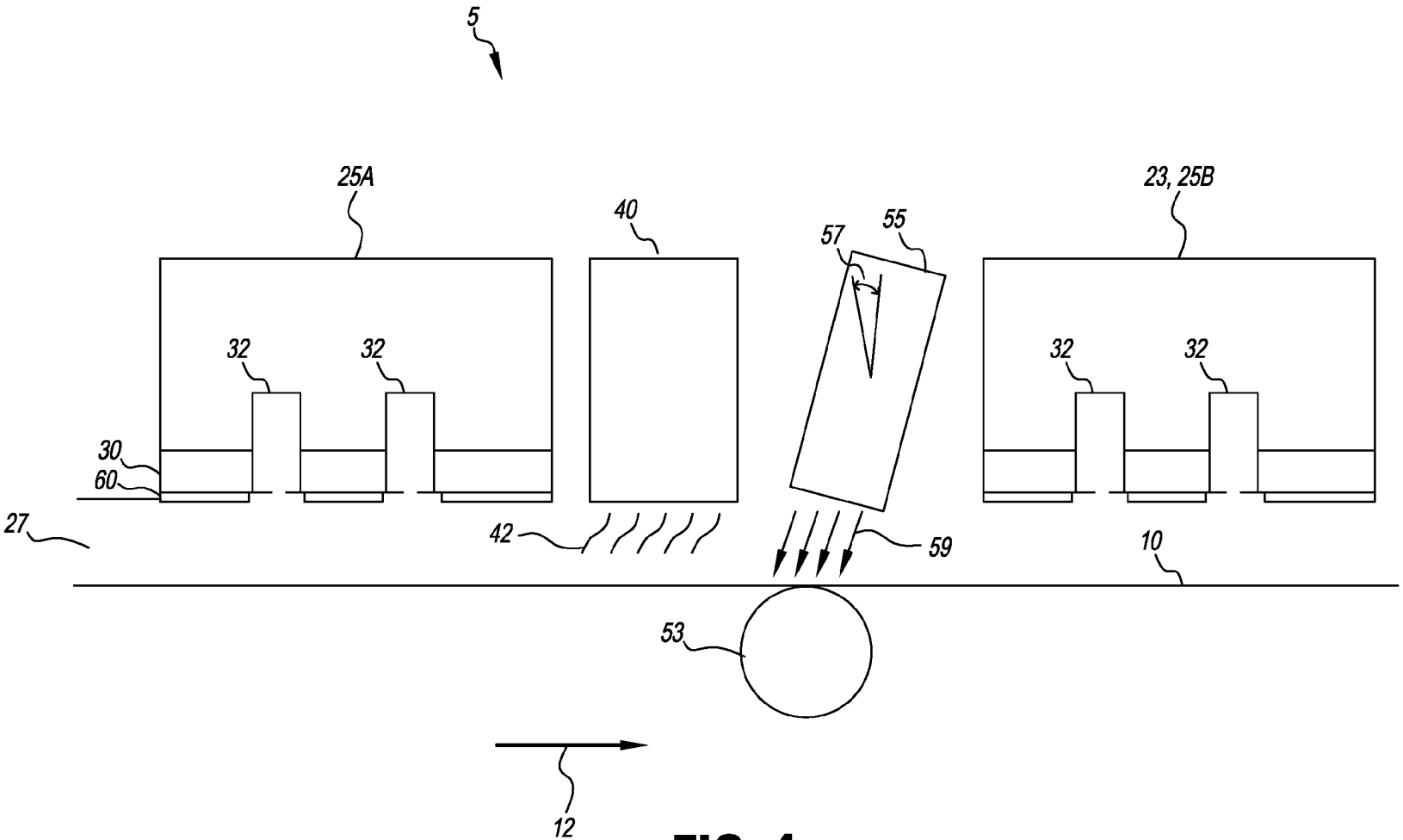
FIG. 4 is a schematic side view of a portion of the digital printing system, where the support structure face adjacent to the print media has a thermal insulator and an air knife to reduce condensation accumulation.

The terms "upstream" and "downstream" are terms of art referring to relative positions along the transport path of the print media; points on the transport path move from upstream to downstream. In FIGS. 1, 2, and 4, the media moves from left to right as indicated by feed direction arrow 12. Where they are used, terms such as "first", "second", and so on, do not necessarily denote any ordinal or priority relation, but are simply used to more clearly distinguish one element from another.

Referring to FIG. 1, there is shown a digital printing system 5 for continuous web printing on a print media 10. The digital printing system 5 includes a first module 15 and a second module 20, each of which includes lineheads 25, dryers 40, and a quality control sensor 45. In addition, the first module 15 and the second module 20 include a web tension system (not shown) that serves to physically move the print media 10 through the digital printing system 5 in the feed direction 12 (left to right as shown in the figure).

The print media 10 enters the first module 15, from the source roll (not shown). The linehead(s) 25 of the first module applies ink to one side of the print media 10. As the print media 10 feeds into the second module 20, there is a turnover mechanism 50 which inverts the print media 10 so that linehead(s) 25 of the second module 20 can apply ink to the other side of the print media 10. The print media 10 then exits the second module 20 and is collected by a print media receiving unit (not shown). For descriptive purposes only, the lineheads 25 are labeled a first linehead 25-1, a second linehead 25-2, a third linehead 25-3, and a fourth linehead 25-4.

Figure 3:
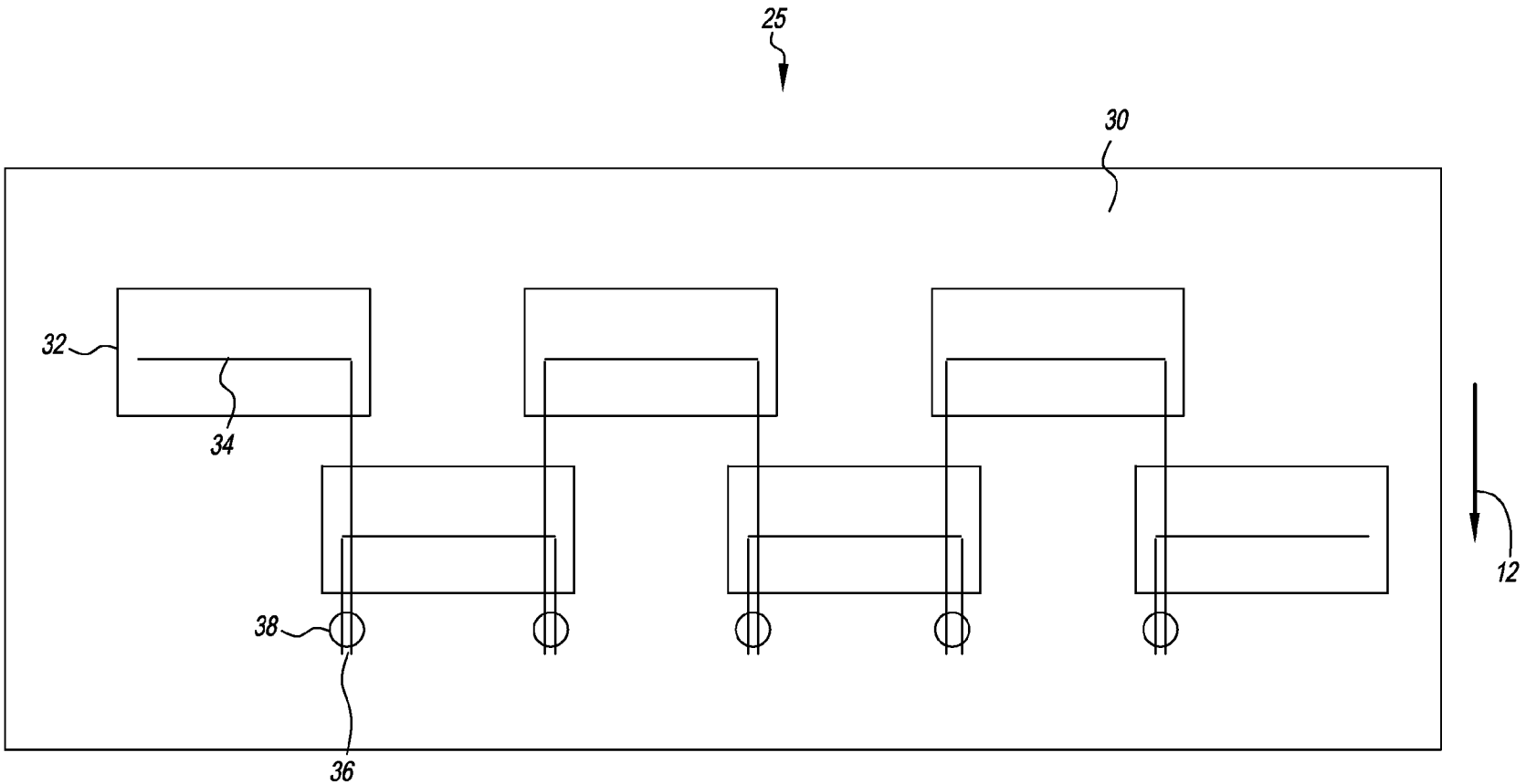
FIG. 3 is a schematic view of a support structure face adjacent to the print media, with printheads aligned in a staggered formation, producing overlap regions that correspond to the increased condensation regions.

Referring to FIG. 2, a portion of the digital printing system 5 is shown in more detail. As the print media 10 is directed through the digital printing system 5, the lineheads 25, which typically include a plurality of printheads 32, apply ink or another liquid, via the nozzle arrays 34 of the printheads 32. The printheads 32 within the linehead 25 are located and aligned by a support structure 30. (One such arrangement of printheads 32 in the linehead 25 is shown in FIG. 3.) As the ink applied to the print media 10 dries by evaporation, the humidity of the air above the print media 10 rises in the clearance gap 27 between the printer components (for example, lineheads 25 and dryers 40) and the print media 10. To simplify the description, terms such as moisture, humid, humidity, and dew point that in a proper sense relate only to water in either a liquid or gaseous form, are used to refer to the corresponding liquid or gaseous phases of the solvents that make up a large portion of the inks and other coating fluids applied by the printheads 32. When the ink or other coating fluid is based on a solvent other than water, these terms are intended to refer to the liquid and gaseous forms of such solvents in a corresponding manner.

As the print media 10 moves in the feed direction 12 (left to right as shown in the figure), the warm humid air adjacent to the print media 10 is dragged along or entrained by the moving print media 10. As a result, a convective current develops and causes the warm humid air to flow downstream. When this happens, the warm humid air in the clearance gap 27 often comes into contact with downstream components of the printing system 5, such as, for example, the second linehead 25-2, and more particularly, the support structure 30 of the second linehead 25-2. If the temperature of the support structure 30 is below the dew point of the warm humid air in the clearance gap 27, moisture condenses out of the humid air onto the support structure 30 of the lineheads. As ink is continually being printed on the print media 10, which then passes through the dryer 40 to dry the ink on the print media 10, moisture is continually being added to the air in the clearance gap 27. This continuous supply of moist air often leads to large amounts of moisture condensing on downstream components of the printing system 5. Typically, there is an increased condensation region 38 on the downstream portion of the support structure 30 (also shown in FIG. 3). If sufficient condensation accumulates on one or more of the printing system components, it can drip onto or otherwise touches the print media 10 which adversely affects print quality.

As described with reference to FIG. 2, warm humid air produced by the printheads 32 of the first linehead 25-1 under certain circumstances produces sufficient moisture in clearance gap 27 which causes the moisture to condense on the downstream portion of the support structure 30 of the first linehead 25-1. If multiple lineheads 25 are printing onto the print media 10, this problem is compounded. The clearance gap 27 under the second linehead 25-2 will include moisture produced by the printing of both the first and second lineheads 25-1, 25-2. As a result, condensation is more of a problem for the downstream lineheads 25 (for example, the fourth linehead 25-4) than for the upstream lineheads 25 (for example, the first linehead 25-1).

After the ink is jetted onto the print media 10, the print media 10 passes beneath the one or more dryers 40 which apply heat 42 to the ink on the print media. The applied heat 42 accelerates the evaporation of the water or other solvents in the ink. Although the dryers 40 often include an exhaust duct for removing the resulting warm humid air from above the print media, some warm humid air can still be dragged along by the moving print media 10 as it leaves the dryer 40. This can also result in relatively high humidity air in the clearance gap 27 between the print media 10 and downstream components such as the third linehead 25-3.

Additionally, the print media 10 remains at an increased temperature after leaving the dryer 40 causing the ink to continue to evaporate, thereby adding moisture into the clearance gap 27. As such, the condensation issue is further amplified on lineheads 25 downstream of the dryer 40.

As the ink drops are jetted from nozzles of the nozzle array 34 either to the drop selection hardware or the print media 10, some of the solvent, water or otherwise, can evaporate moisture into the clearance gap 27. In continuous inkjet printers in particular, due to their continuous formation of streams of drops, this can add significant amounts of moisture to the air along the length of the nozzle array 34 even when nothing is being printed by the printhead 32. Solvent can also evaporate creating significant amounts of moisture during printing, especially during heavy coverage printing, in both continuous inkjet and drop-on-demand printing systems.

As ink is continually printed on the print media 10, which then passes through the dryer 40 to dry the ink on the print media 10, moisture is continually added to the air in the clearance gap 27. This continuous supply of moist air can lead to large amounts of moisture condensing on downstream components in the printing system 5. Again, sufficient condensation can accumulate such that it drips onto or otherwise touches the print media 10 adversely affecting print quality.

Referring to FIG. 3, a face of the support structure 30 that is adjacent to the print media 10 and separated by the clearance gap 27 is shown. The printheads 32 are aligned in a staggered formation, with upstream and downstream printheads 32, such that the nozzle arrays 34 produce overlap regions 36. The overlap regions 36 enable the print from overlapped printheads 32 to be stitched together without a visible seam through the use of appropriate stitching algorithms that are known in the art. These stitching algorithms ensure that the amount of ink printed in the overlap region 36 is not higher than other portions of the print. The uniform print coverage should yield uniform ink evaporation across the print width, and therefore a uniform problem with respect to condensation on downstream components. It has been found, however, that there are increased condensation regions 38 which correspond to the overlap regions 36.

It is thought that the increased condensation regions 38 are due to humidity added to the clearance gap 27 directly by the printheads 32. As the ink drops jet from the nozzle either to the drop selection hardware or the print media 10, some of the solvent, water or otherwise, can evaporate. Continuous inkjet printing systems, due to their continuous formation of streams of drops, are thought to add significant amounts of moisture to the air along the length of the nozzle array 34 even when nothing is printed by the printhead 32. It is thought that the overlap region 36, which receives moist air from both the upstream and the downstream printheads 32 in the linehead 25, has a higher humidity level with correspondingly higher dew point than other areas across the print width.

FIG. 4 is a schematic side view of a portion of the digital printing system 5 that includes an example embodiment of the invention. The support structure 30 face adjacent to the print media 10 includes a thermal insulator 60 which includes a material with a low thermal conductivity. When the warm humid air in the clearance gap 27 contacts the thermal insulator 60, some moisture can initially condense on the surface of the thermal insulator 60 if the surface temperature is below the dew point for the humid air. The condensation of this moisture on the surface, however, releases vaporization heat to the surface of the thermal insulator 60. The low thermal conductivity of the material limits the transfer of this heat through the thermal insulator 60 to the support structure 30. As a result, the temperature of the surface of the thermal insulator 60 rises. The rising surface temperature reduces the rate at which moisture condenses on the thermal insulator 60 surface until the surface temperature rises above the dew point which stops further condensation of the surface of the thermal insulator 60. In this manner, thermal insulator 60 serves to limit, reduce, or even eliminate the formation of condensation which otherwise can occur as a result of warm humid air that is produced during the inkjet printing process.

The low thermal conductivity enables the thermal insulator 60 to effectively insulate, without requiring a large thickness. This is important, as increasing the clearance gap 27, the height or distance between the printhead 32 and the print media 10, can adversely affect print quality. A preferred material for the thermal insulator 60 is an aerogel material, particularly, a silica aerogel material. Aerogel materials are known to have excellent insulating properties, for example, silica aerogel can have a thermal conductivity of 0.03 W/(m·K) down to 0.004 W/(m·K). Other materials suitable for the thermal insulator 60 are extruded or expanded polystyrene which has a thermal conductivity of 0.03 W/(m·K).

In other example embodiments, the thermal insulator 60 material also has low heat capacity. The low heat capacity of these materials enables the surface temperature of the material to more quickly rise as it is heated by the condensation of moisture on the surface. Aerogels, including silica aerogels, and polymeric foam insulating materials, such as an extruded or expanded polystryrene, have a sufficiently low heat capacity.

In another example embodiment, the thermal insulator 60 includes a thermal barrier coating that is applied directly to the surface (face) of the support structure 30 adjacent to the print media 10. The thermal barrier coating includes a polymeric coating material with thermal insulation particles dispersed therein. The polymeric coating material can be a paint, an epoxy, or another liquid that is applied wet and then evaporates or cures in order to form a solid coating. The thermal insulating particles form voids within the coating liquid that serve to limit, reduce, or even prevent conductive heat transfer.

The thermal insulating particles can include ceramic microspheres that are hollow with an internal vacuum or volume of gas, such as those manufactured by Hy-Tech Thermal Solutions. The internal vacuum or volume of gas of the ceramic microspheres serves to reduce or limit conductive heat transfer through the coating liquid. Additionally, the thermal insulation particles can include particles having a low thermal conductivity, such as Nanogel® aerogel, as manufactured by Cabot Corporation.

Generally, when a thermal coating is applied to the support structure 30, the thermal insulation particles are widely dispersed throughout the coating liquid. As the coating liquid dries, or evaporates, the thermal insulation particles become tightly packed, forming the thermal coating. The result is the thermal barrier coating with numerous voids that limit conductive heat transfer through the coating.

Referring back to FIG. 4, as the print media 10 moves in the feed direction 12 (left to right as shown in the figure), warm humid air is produced from evaporation, heat 42 from the dryer 40, and from the ink jetted from the nozzle array 34 in the printhead 32. The thermal insulator 60 serves to prevent the warm humid air from coming into contact with the surface or face of the support structure 30 thereby reducing or limiting condensation.

In other example embodiments, the printing system 5 also includes a gas flow source 55 configured to direct a gas flow 59 at the print media 10. As shown in FIG. 4, the gas flow source 55 is positioned downstream of a linehead 25A and the dryer 40. The support structure 30 of the linehead 25A includes the thermal insulator 60 on at least a portion of the face adjacent to the print media 10. The gas flow 59 directed at the print media 10 by the gas flow source 55 positioned upstream of printing system component 23, for example, linehead 25B, limits or even prevents the warm humid air entrained by the moving print media from entering the clearance gap 27 between the downstream component 23 and the print media 10. As shown, the gas flow source 55 is oriented at a gas flow angle 57. The gas flow angle 57 is measured from a vertical axis that is perpendicular to the print media 10. The gas flow angle 57 can be zero (for example, perpendicular) or at an angle such that the flow of air is directed both down at the print media 10 and upstream toward the clearance gap 27 under the dryer 40, or other upstream component, depending on the application. A backing roller 53 can be used to support and guide the print media 10 to prevent the print media 10 from fluttering or otherwise moving as a result of the gas flow 59. By limiting flutter of the print media, the backing roller 53 enables higher gas flow pressures to be used, increasing the heat transfer coefficient and moisture stripping power of the impingement process. Alternatively, an opposing gas flow directed at the other side of the print media 10 can be included in order to prevent the print media 10 from fluttering.

The gas flow source 55 can produce the gas flow 59 via a blower or compressed air that directs air through a discharge slot. Preferably, the gas flow 59 is uniform across the print media 10, such as is provided by commercially available air knives. It is contemplated, however, that the gas flow 59 can vary along the width of the print media 10, for example, having increased flow corresponding to the overlap regions 36 (shown in FIG. 3). The gas flow 59 can also include a source of an ionic wind, produced by a high voltage wire located across the print media.

The layer of warm, humid air dragged along by the moving print media is stripped away from the print media 10 by the gas flow 59 directed at the print media 10. By stripping the entrained humid air away from the print media 10, the gas flow 59 reduces the moisture level in the clearance gap 27 between the print media 10 and printer components that are located downstream of the gas flow 59. In some example embodiments, the gas flow source includes a heating apparatus to raise the temperature of the gas flow directed at the print media. The heating apparatus can be a gas or electric heater, or a heat exchanger that transfers heat from another portion of the printing system to the gas flow. Raising the temperature of this gas flow serves to lower the relative humidity of the gas flow which helps to lower the relative humidity in the clearance gap between the print media 10 and printer components 23 that are located downstream of the gas flow 59.

The gas flow 59 directed at the print media 10 not only strips the moist air away from the print media 10, but it also serves to dilute moist air with less humid air, further lowering the humidity in the clearance gap 27 of downstream components. When the gas flow 59 is directed at the print media 10 downstream from a dryer 40 that includes an exhaust duct (not shown), the moist air stripped away from the print media 10 by the gas flow can be removed from the printing system through the exhaust duct. Additionally, although FIG. 4 shows the gas flow source downstream of both the dryer 40 and the linehead 25, the gas flow 59 directed at the print media 10 by a gas flow source 55 is also be effective in reducing condensation on a downstream printing system component when located between the linehead and the downstream component when dryer 40 is not included in the printing system 5.

As shown in FIG. 4, printing system component 23 is located along the transport path downstream of the gas flow source 55 and is depicted as the linehead 25. In alternative embodiments, the component 23 can include other types of printing system components that interact with the print media as the print media is transported past them. These components include, for example, image quality sensors, image registration sensors, color sensors, ink or media coating curing systems such as UV sources, web tension devices, web guiding structures such as rollers and turnover mechanisms, and combinations thereof.

Although the thermal insulator 60 is effectively used to reduce the risk of condensation on the support structure 30 of the linehead 25, the nature of many of downstream components can preclude the use of the thermal insulator 60 on the face adjacent to the print media as the thermal insulator 60 would impede the normal function of such components. For example, the thermal insulator 60 can obstruct the light path for many sensors or UV cure systems. The gas flow 59 directed at the print media 10 downstream of the linehead 25 and upstream of other printing system components 23 can reduce the risk of condensation on these components that cannot be protected by way of thermal insulation.

Referring back to FIG. 4, the printing system component 23 is a linehead 25B made up of a plurality of inkjet printheads 32 and a support structure 30. A thermal insulator 60 covers as least a portion of the face of the support structure 30 adjacent to the print media 10 to reduce condensation build up on the face. Upstream of this linehead is another linehead 25A made up of a plurality of inkjet printheads 32 for printing on the print media 10 and another support structure 30 for locating the second plurality of printheads 32 relative to the print media 10. A dryer 40 is positioned downstream from the linehead 25A, and upstream of linehead 25B, relative to a direction of travel 12 of the print media 10. A gas flow source 55 configured to direct a flow of gas 59 toward the print media 10 is positioned upstream from the linehead 25B and downstream from the dryer 40 relative to a direction of travel 12 of the print media 10. As shown, the support plate 30 of linehead 25A has a thermal insulator 60 covering at least a portion of the face or surface adjacent to the print media 10. In embodiments where the potential for condensation on the support plate 30 of linehead 25A is low, the use of a thermal insulator 60 on the support structure of upstream linehead 25A is optional.

Figure 5:
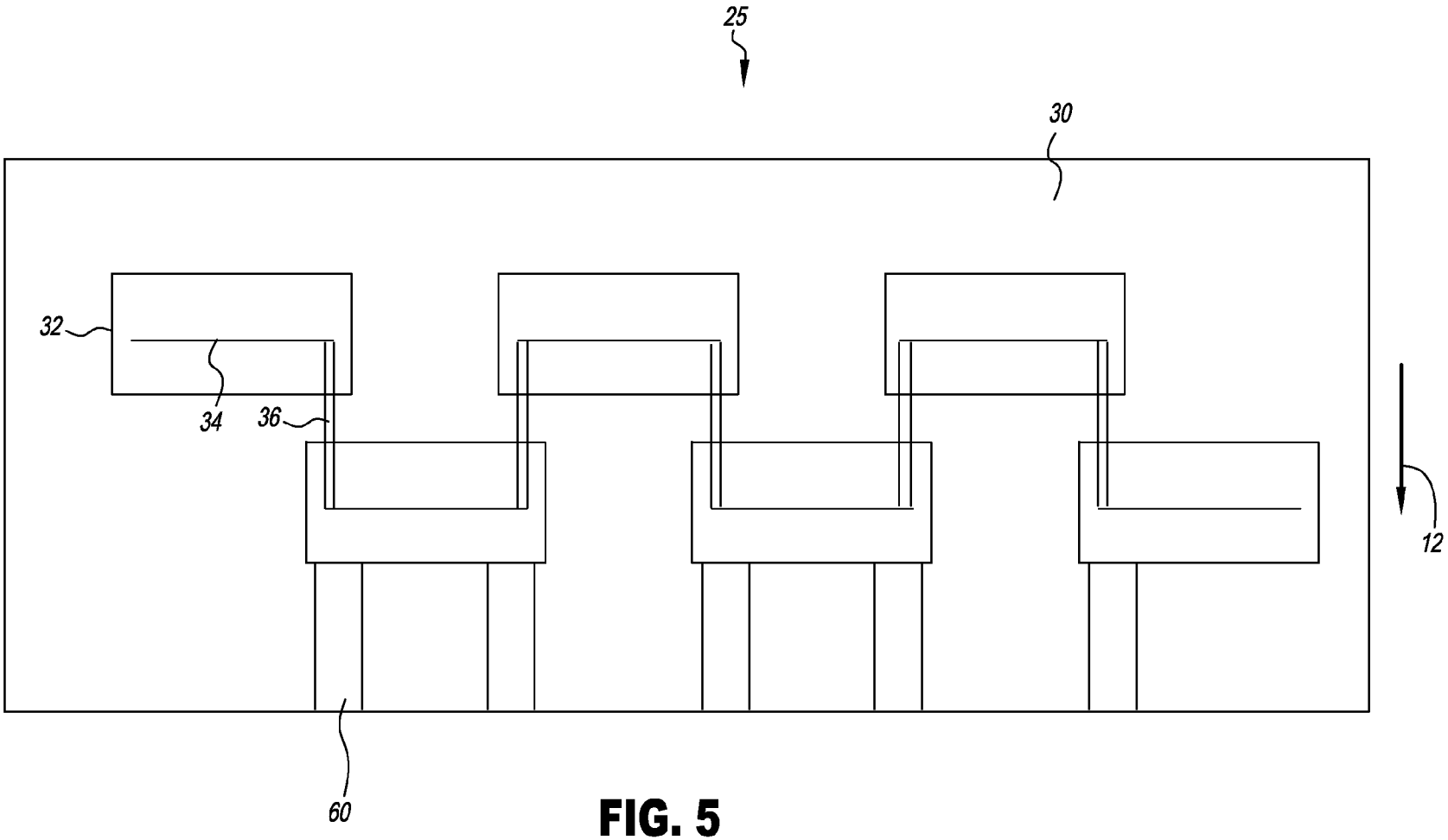
FIG. 5 is a schematic view of the support structure face, where there is a plurality of thermal insulators corresponding to the overlap regions.

Referring to FIG. 5, as discussed above, it has been found that condensation is more likely to build up in certain regions of the support plate 30. In some example embodiments, the thermal insulator 60 is attached to the support plate 30 in regions prone to have increased condensation rather than covering the entire support plate. As shown in FIG. 5, there is a plurality of thermal insulators 60 affixed to selected portions of the support structure 30. The staggered formation of the printheads 32 and the nozzle arrays 34 create the overlap regions 36 that are susceptible to increased moisture build up. The plurality of thermal insulators 60 is located such that support structure 30 is insulated from the increased volume of warm humid air in the overlap regions 36. As a result, condensation at these increased condensation regions 38 (shown in FIG. 3) is effectively limited or reduced.

Although FIG. 5 shows a plurality of thermal insulators 60, it is possible for the thermal insulator 60 to cover the entire face of the support structure 30 that is adjacent to the print media 10 (as shown in FIG. 4). In some embodiments, the thermal insulator 60 is applied to the regions prone to have increased condensation for some of the support structures 30 in the printing system, while a thermal insulator 60 is applied to the entire face of the support structure 30 for other support structures in the printing system 5. For example, and referring back to FIG. 1, since the risk of condensation is quite low on the support structure of the first linehead 25-1, the thermal insulator 60 needs only cover the increased condensation regions 38 on linehead 25-1. The fourth linehead 25-4, however, which has a much higher risk of condensation build up due to following three lineheads 25 and two dryers 40 includes a thermal insulator 60 applied to the entire lower face of support structure 30 for that linehead 25.

Figure 6:
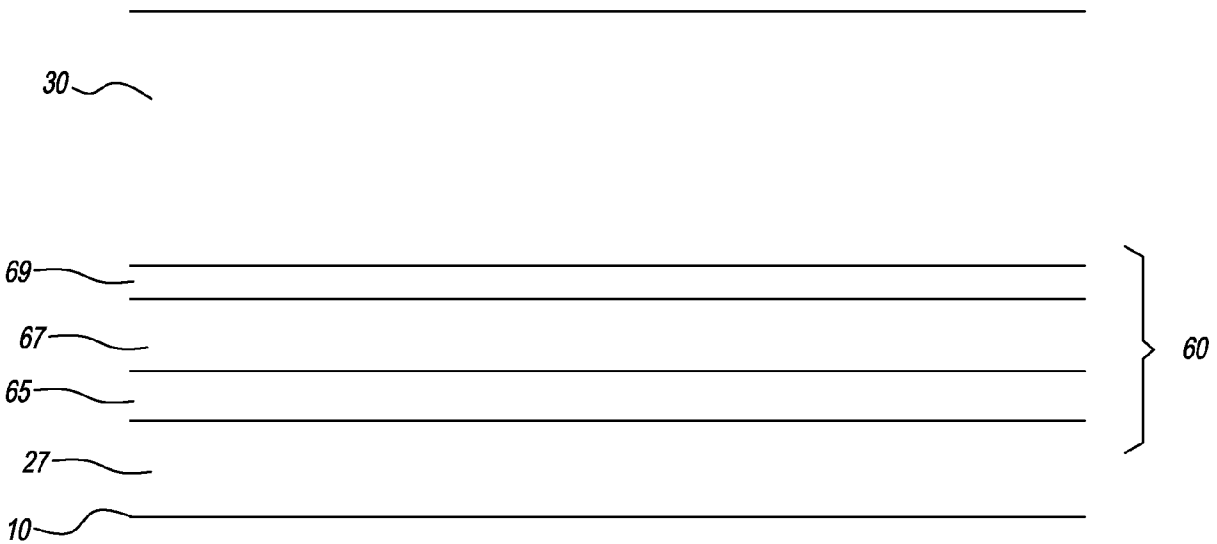
FIG. 6 is a schematic side view of the support structure having the thermal insulator and a protective layer according to another embodiment

Referring to FIG. 6, support structure 30 including a thermal insulator 60 is shown. In this embodiment, a protective layer 65 is attached to and in contact with the face of the thermal insulator 60 that faces the print media 10. The protective layer 65 is non-porous and serves to prevent moisture from being absorbed by or otherwise affecting the thermal insulator 60. The protective layer 65 also provides some protection from physical damage to the thermal insulator 60, for example, protection from physical damage caused by an impact of the print media 10 against the bottom of the support plate 30 or protection from physical damage that occurs during a maintenance operation that cleans dried ink mist or other deposits from the bottom of the thermal insulator 60. Relatively speaking, the protective layer 65 has a large surface area and a small thickness, preferably less than 0.01 inches. As such, the protective layer 65 has a low thermal capacity and approaches the ambient temperature or dew point of the warm humid air in the clearance gap 27. Therefore, the temperature difference between the warm humid air and the protective layer 65 approaches zero, and as such, condensation is less likely to form on the protective layer 65. Preferably, the protective layer 65 includes a thin layer of material with a high thermal conductivity, such as stainless steel or aluminum. The high thermal conductivity of the protective layer 65 helps to distribute heat more uniformly across the protective layer so that the temperature of the entire surface will rise more uniformly. Additionally, the protective layer 65 preferably has an emissivity greater than 0.75 to better absorb thermal energy radiating off of the print media 10. For example, the protective layer 65 is preferably anodized black in color. Alternatively, the protective layer 65 can be another dark color.

As discussed above, the materials that make up the thermal insulator 60 are exposed to moisture and are susceptible to damage. Commercially available silica aerogels, such as Pyrogel®, include silica aerogel embedded with reinforcing fibers in the form of an insulation blanket. In this form, the aerogel material can produce dust as well as collect moisture and debris. As such, it is also contemplated that the thermal insulator 60 include a mounting layer 69 that along with the protective layer 65 encapsulate the thermal insulating layer 67 forming a laminated insulator, as shown in FIG. 6. To provide for encapsulation and to secure the laminated insulator, an epoxy, caulk, or other adhesive sealing can be used to seal the edges. The mounting layer 69 also serves as a foundation structure for the thermal insulator 60 because the thermal insulation layer 67 is often flexible. The foundation provided by the mounting layer 69 can aid in the mounting of the laminated insulator to the support structure 30. The thermal insulator 60, laminated or otherwise, and the protective layer 65 can be secured to the support structure 30 in a variety of ways, including, for example, adhesive tape, screws, bolts, or other fasteners.

The invention has been described in detail with particular reference to certain preferred embodiments thereof, but it will be understood that variations, modifications, and combinations can be effected within the scope of the invention.

PARTS LIST

5 Digital printing system
10 Print media
12 Feed direction
15 First module
20 Second module
23 Component
25 Linehead
27 Clearance gap
30 Support structure
32 Printhead
34 Nozzle array
36 Overlap regions
38 Increased condensation regions
40 Dryer
42 Heat
45 Quality control sensor
50 Print media turnover mechanism
53 Backing Roller
55 Gas flow source
57 Gas flow angle
59 Gas flow
60 Thermal insulator
65 Protective layer
67 Thermal insulation layer
69 Mounting layer

The invention claimed is:

1. A printing system comprising:
a moving print media that entrains humid air;
a plurality of inkjet printheads spaced apart from the moving print media by a clearance gap, the plurality of inkjet printheads being positioned to print on the moving print media with a liquid that adds humidity to the entrained humid air in the clearance gap; and
a support structure for locating the plurality of printheads relative to the print media, the support structure including a face adjacent to the humid air entrained by the moving print media, the face of the support structure including a thermal insulator that reduces condensation on the support structure of the humid air in the clearance gap.

2. The printing system of claim 1, wherein the thermal insulator has a thermal conductivity of less than or equal to 0.03 W/(m·K).

3. The printing system of claim 1, wherein the thermal insulator includes an aerogel material.

4. The printing system of claim 3, wherein the aerogel material includes a silica aerogel material.

5. The printing system of claim 1, the thermal insulator including a plurality of thermal insulators spaced apart from each other on the face of the support structure.

6. The printing system of claim 4, wherein each of the plurality of thermal insulators is aligned with an overlapping region between printheads of the plurality of printheads.

7. The printing system of claim 1, the thermal insulator further comprising a protective layer in contact with the exposed face of the thermal insulator.

8. The printing system of claim 7, wherein the protective layer is a thermally conductive material layer.

9. The printing system of claim 8, wherein the thermally conductive material layer includes a thickness that is less than 0.01 inches.

10. The printing system of claim 7, where in the protective layer has an emissivity greater than 0.75.

11. The printing system of claim 7, wherein the protective layer is a non-porous material.

12. The printing system of claim 1, the plurality of inkjet printheads and the support structure forming a linehead, the printing system further comprising:
another printing system component;

a gas flow source configured to direct a flow of a gas toward the recording media, the gas flow source positioned between the linehead and the other printing system component.

13. The printing system of claim 1, the plurality of inkjet printheads and the support structure forming a first linehead, the system further comprising:

a second linehead positioned upstream from the first linehead relative to a direction of travel of the recording media, the second linehead including:

a plurality of inkjet printheads for printing on the print media that is moved relative to the second plurality of printheads; and a second support structure for locating the second plurality of printheads relative to the recording media;

a dryer positioned downstream from the second linehead relative to a direction of travel of the recording media; and a gas flow source configured to direct a flow of gas toward the print media, the gas flow source positioned upstream from the first linehead relative to a direction of travel of the recording media and downstream from the dryer relative to a direction of travel of the recording media.

14. The printing system of claim 13, wherein the second support structure includes a second thermal insulator.

15. The printing system of claim 1, wherein a portion of a face of at least one of the printheads of the plurality of printheads includes a thermal insulator, the printhead face adjacent to the recording media.

16. The printing system of claim 1, wherein the thermal insulator is a laminated insulator, the laminated insulator comprising:

a mounting layer;

a thermal insulation layer; and a protective layer;

wherein the mounting layer and the protective layer are sealed as to encapsulate the thermal insulation layer between the mounting layer and the protective layer.

17. The printing system of claim 16, wherein the thermal insulation layer is a silica aerogel material.

18. The printing system of claim 17, the silica aerogel material further comprising reinforcing fibers.

19. The printing system of claim 16, wherein the protective layer is a thermally conductive material.

20. The printing system of claim 1, the thermal insulator comprising a thermal barrier coating.

* * * * *